US005697735A

United States Patent [19]

Egan

[11] Patent Number: 5,697,735

[45] Date of Patent: Dec. 16, 1997

[54] CUT WALL CONFINEMENT CELL

[75] Inventor: Philip D. Egan, Atlanta, Ga.

[73] Assignee: The Tensar Corporation, Atlanta, Ga.

[21] Appl. No.: 461,850

[22] Filed: Jun. 5, 1995

[51] Int. Cl.[6] ..... E02D 3/02; E02D 29/00

[52] U.S. Cl. ..... 405/262; 405/284; 405/286

[58] Field of Search ..... 405/262, 258, 405/284, 286

[56] References Cited

U.S. PATENT DOCUMENTS

| | | | |
|---|---|---|---|
| D. 274,762 | 7/1984 | Toffolon | D34/33 |
| 4,011,728 | 3/1977 | Turzillo | 405/222 |
| 4,050,254 | 9/1977 | Meheen et al. | 405/285 |
| 4,196,161 | 4/1980 | Toffolon et al. | 264/71 |
| 4,251,196 | 2/1981 | Toffolon et al. | 425/173 |
| 4,324,508 | 4/1982 | Hilfiker et al. | 405/284 |
| 4,341,491 | 7/1982 | Neumann | 405/262 X |
| 4,351,507 | 9/1982 | Toffolon et al. | 249/63 |
| 4,372,091 | 2/1983 | Brown et al. | 52/593 |
| 4,374,798 | 2/1983 | Mercer | 264/288.8 |
| 4,474,400 | 10/1984 | Toffolon | 294/97 |
| 4,530,622 | 7/1985 | Mercer | 405/258 |
| 4,684,294 | 8/1987 | O'Neill | 405/286 |
| 4,685,838 | 8/1987 | Curt | 405/284 |
| 4,707,962 | 11/1987 | Meheen | 52/565 |
| 4,728,227 | 3/1988 | Wilson et al. | 405/284 |
| 4,824,293 | 4/1989 | Brown et al. | 405/284 |
| 4,914,887 | 4/1990 | Meheen | 405/284 |
| 4,929,125 | 5/1990 | Hilfiker | 405/262 |
| 5,131,791 | 7/1992 | Kitziller | 405/286 |
| 5,190,413 | 3/1993 | Carey | 405/262 X |
| 5,259,704 | 11/1993 | Orgorchock | 405/262 |
| 5,320,455 | 6/1994 | Mattox | 405/262 X |
| 5,378,088 | 1/1995 | Foehrkolb | 405/262 X |
| 5,505,563 | 4/1996 | Curt | 405/262 |

OTHER PUBLICATIONS

Doublewal "The Interlocking Precast Gravity Wall System" Brochure.

T–Wall "Construction Procedures" Brochure.

Tensar "Concrete GeoWall Package" Brochure.

Brochure—"Terra–Link, Cellular Earth Retaining Structures", 28 pages.

*Primary Examiner*—Tamara L. Graysay
*Assistant Examiner*—Tara L. Mayo
*Attorney, Agent, or Firm*—Jacobson, Price, Holman & Stern, PLLC

[57] ABSTRACT

Precast concrete wall panels are assembled to form a retaining wall in front of a cut wall face. Arched confinement cells are formed behind the wall panels by sections of vertically oriented sheet material for reception and retention of a particulate fill material. Preferably, flat, precast concrete wall panels provided with vertically oriented tabs of integral geogrid projecting rearwardly from opposite sides of a rear face thereof which are connected to opposite end portions of a length of vertically oriented geogrid by a Bodkin joint. The thus formed confinement cells are generally semi-circular. The fill material initially used fills the confinement cells and then the space around the confinement cells and in front of the cut wall face. The wall panels are vertically staggered and successive courses of confinement cells are filled until reaching a desired height for the retaining wall.

35 Claims, 4 Drawing Sheets

CUT WALL CONFINEMENT CELL

FIELD OF THE INVENTION

The present invention is concerned with producing a retaining wall in a cut wall environment of limited depth. The retaining wall is formed by a plurality of precast concrete wall panels to which are secured confinement cells preferably made of grid-like sheets of material.

BACKGROUND OF THE INVENTION

Retaining walls are commonly used for architectural and site development applications. The wall facing must withstand very high pressures exerted by backfill soils. Reinforcement and stabilization of the soil backfill in mechanically stabilized earth applications is commonly provided by grid-like sheet materials that are placed in horizontally extending layers in the soil fill behind the wall face to interlock with the soil and create a stable reinforced soil mass. Connection of the reinforcing material to the elements forming the wall holds the wall elements in place and resists soil backfill pressures.

A preferred form of grid-like tie-back sheet material used to reinforce the soil behind a retaining wall structure, known as an integral geogrid, is commercially available from The Tensar Corporation of Atlanta, Ga. ("Tensar") and is made by the process disclosed in U.S. Pat. No. 4,374,798 ("the '798 patent"), the subject matter of which is incorporated herein in its entirety by reference. In the optimum embodiments of this invention, integral geogrid tie-back sheet material which has been uniaxially oriented according to the '798 patent includes a plurality of elongated, parallel, molecularly oriented strands with transversely extending bars integrally connected thereto by less oriented or unoriented junctions, the strands, bars and junctions together defining a multiplicity of elongated openings. However, other forms of tie-back sheet materials have also been used as horizontally extending reinforcing means in the construction of retaining walls, and the instant inventive concepts are equally applicable with the use of such materials.

In a brochure entitled "Concrete Geowall Package", published by Tensar in 1986, various retaining wall structures are shown using full height cast concrete panels. In one such retaining wall structure short strips, or tabs, of geogrid material, such as shown in the '798 patent, are embedded in and extend horizontally from the cast wall panels. On site, longer strips of horizontally extending geogrid are used to reinforce the wall fill, creating a stable soil mass. To connect the horizontally extending geogrid tabs to the horizontally extending reinforcing geogrid, the strands of one portion of geogrid are bent to form loops, the loops are inserted between the strands of the other portion of geogrid so that the loops project out of the second portion of geogrid, and a horizontally extending rod is passed through the loops on the opposite side of the second portion to prevent the loops from being pulled back through, thereby forming a tight interconnection between the two portions of geogrid, sometimes referred to as a "Bodkin" joint. The use of a Bodkin joint is disclosed in U.S. Pat. No. 4,530,622 to Mercer, the subject matter of which is incorporated herein in its entirety by reference.

Other techniques are known for connecting tie-back sheets such as geogrid to the elements forming a retaining wall. For example, in U.S. Pat. No. 4,824,293 ("the '293 patent"), the subject matter of which is incorporated herein in its entirety by reference, a horizontally extending preformed channel in a concrete panel communicates through a slit formed between the channel and a rear face of the concrete panel for retention of a tieback sheet utilized to affix the concrete panel to an underlying mass. The tieback sheet is retained by the concrete panel by a mechanical interference fit between the walls of the slit and an enlarged portion of the tieback sheet located within the channel. Alternatively, an interference rod may be inserted into the channel to mechanically retain the tieback sheet in place.

Use of full height pre-cast concrete wall panels for wall-facing elements in a retaining wall traditionally requires an area behind the retaining wall of approximately 70% of the total wall height. This clearance area is required to accommodate the horizontally extending geogrid extending rearwardly into the fill material to anchor the wall.

However, in some environments, only a limited depth of excavation is possible due to preexisting conditions, such as buried utility lines or the presence of a rock face, for example. Accordingly, alternate systems have been developed to accommodate a limited depth excavation for erection of a retaining wall. These limited depth excavations are referred to as a "cut wall" operation.

One known system for erecting a retaining wall in a cut wall environment of limited depth, is commercially available under the trade name DOUBLEWAL®. Discussion of this system is included in U.S. Pat. Nos. 4,196,161, 4,251,196, 4,351,507, 4,372,091, 4,474,400 and D-274,762, the subject matter of each of which is incorporated herein by reference for further background.

The DOUBLEWAL® system confines a significant mass of soil fill in massive concrete structural units having a pair of spaced side panels interconnected by connecting arms spaced inwardly from the ends of the side panels. By positioning adjacent structural units together, a series of approximately square shaped boxes are formed for receipt of the fill material.

A mortise-tendon connection is formed between superimposed units stacked vertically so that a vertically recessed mortise at the bottom of each superimposed connecting arm fits within a complementary shaped vertically projecting tendon at the top of each arm of a lower course of structural units. The units may be stacked vertically in alignment or in horizontally staggered rows with horizontal displacement between units and adjacent rows equal to approximately one half the length of a unit. The stacked units provide columnar openings which are filled for added structural integrity of the wall so as to form a gravity type wall.

Another system for erecting a retaining wall in a limited depth, cut wall environment is commercially available under the name T-WALL and is described in U.S. Pat. No. 4,684,294, the subject matter of which is also incorporated herein by reference for background. In this system, a concrete form includes a front face and a centrally located, rearwardly projecting stem. The stem extends into and firmly engages with a soil mass located behind the front face. Notches in the stem provide for interengagment with support beams in the soil mass.

Granular backfill material is deposited directly on top of the stems so as to charge the compartments formed on opposite sides of the stems with equal amounts of backfill material and to prevent lateral movement of the concrete form. It is also desirable to include shear keys in a space created between teeth on the top and bottom surfaces of two superimposed stems. The purpose of these keys is to prevent movement of the unit during backfill operations.

A commercially significant problem encountered in the use of such prior art systems is the cost involved in casting complex concrete forms and the skilled labor required to insure proper positioning and filling of the assembled forms.

SUMMARY OF THE INVENTION

Accordingly, it is a primary object of the invention to use tie-back sheets in a unique manner to reinforce a retaining wall in a cut wall environment thereby obviating the above and other problems with prior art approaches to this problem. More specifically, the instant inventive concepts orient the tie-back sheets, preferably uniaxially stretched integral geogrids manufactured by the process of the '798 patent, vertically, rather than horizontally, to form semi-circular hoops or arched confinement zones attached to the rear of precast concrete wall panels to receive soil fill and thereby effectively support the retaining wall in the limited area available in a cut wall environment.

The tie-back sheet material may be secured to the precast concrete retaining wall panels in any convenient manner. Preferably, using polymeric uniaxially oriented geogrid tie-back sheets, the wall panels are each provided with vertically oriented tabs of grid-like material, also preferably uniaxially oriented geogrid tabs, projecting rearwardly from opposite sides of the rear face thereof. Connected to the geogrid tabs, by Bodkin connections, are opposite ends of a length of geogrid oriented so that its transverse bars extend vertically. Thus, an arched confinement cell for reception of soil or other fill, is formed by the geogrid at the rear face of the panel of approximately semi-circular configuration.

Alternately, the ends of a length of geogrid or other tie-back sheet material can be anchored to the rear face of each concrete wall panel to form semi-circular confinement zones in the same way as is disclosed for connecting horizontally extending tieback sheets to a retaining wall structure in the aforementioned '293 patent. That is, opposite ends of each length of geogrid or the like may be locked in vertically extending channels provided along the side edges of the rear face of a wall panel by an interference fit with or without a rod forced with the edges of the sheet material into the channels.

Alternatively, dependent upon the configuration of the wall panel, opposite ends of each length of geogrid may be secured to the rear face of the wall panel in a vertical orientation spaced inwardly from side edges of the wall panel. This type of connection to the wall panel is especially suited for wall panels of non-rectangular/square configuration, such as cross-shaped or hexagonal shaped wall panels, for example. It is only important that the length of geogrid be vertically oriented.

As disclosed in the '798 patent, a high strength grid may be formed by stretching an apertured plastic sheet material. Utilizing the uniaxial techniques, a multiplicity of molecularly-oriented elongated strands and transversely extending bars which are substantially unoriented or less-oriented than the strands are formed. The strands and bars together define a multiplicity of grid openings. With biaxial stretching, the bars are also formed into oriented strands.

As indicated, the preferred grid-like sheet material is a uniaxially-oriented geogrid material as disclosed in the '798 patent. However, biaxial geogrids or grid materials that have been made by different techniques such as woven, knitted or netted grid materials formed of various polymers including the polyolefins, polyamides, polyesters and the like or fiberglass, may be used. In fact, any grid-like sheet material, including steel (welded wire) grids capable of being secured to concrete panels of the instant invention in the manner disclosed herein are suitable. Such materials are referred to herein and in the appended claims as "grid-like sheets of material".

Preferably, when geogrid is used, the geogrid includes a geofabric either secured to the geogrid by a fastener or by heat bonding at the nodes of the geogrid to form a geogrid/fabric composite so as to retain the fill material of a size smaller than the openings between the strands of the geogrid within the confinement cell. As fill material is deposited into the cell, the soil acts to uniformally outwardly flex the geogrid about its circumference to create a symmetrically formed confinement cell.

In an alternate embodiment, it is possible to fill a cell formed by a grid-like sheet of material such as a geogrid, without a geofabric due to the "arching" effect of fill material passing through openings in the grid. As is known, the fill material will eventually form a small arch projecting into the cell at the openings of the grid which will prevent further fill material from passing through the openings, enabling the substantially complete filling of the confinement cell notwithstanding the small apertures in the grid-like nature of the sheets of materials used to contain the fill material.

It is also possible to use imperforate sheets of flexible polymer or the like that can be connected to the rear face of the wall panel by a connection such as disclosed in the '293 patent, for example. While an imperforate sheet of material precludes the loss of fill material since there are no openings between strands as in the grid-like sheets of material avoiding the need to rely on the use of a geofabric for the "arching" effect, uniaxially stretched integral geogrids as preferred herein provide substantial advantages due to the very high strength of the molecularly oriented strands which extend in the circumferential direction of the primary tension created in the arched confinement cell.

In the preferred method of constructing a retaining wall according to the inventive concepts of the present invention, a toe pad is cast of concrete so as to provide a foundation for a first course of concrete panels. In the first course of concrete panels, a plurality of 2.5 feet high by 9 feet long panels are alternated with a plurality of 5 feet high by 9 feet long panels. The toe pad includes a stepped portion to fit with a recessed lower edge of the panels.

After the first course of wall panels are positioned in place, in the smaller 2.5×9 foot panels, an approximately 2 feet high section of geogrid is secured to opposite sides of the rear face of a panel in any desired manner such as a Bodkin joint connected to vertically extending geogrid tabs extending from the rear face of the panel or by a vertically extending channel or a slot connection as disclosed in the '293 patent. When using uniaxial (UX) geogrid in the preferred embodiment, the bars of the UX geogrid extend vertically and the molecularly oriented strands extend horizontally and circumferentially to form a semi-circularly curved confinement cell behind the panel of a depth of approximately 35–45% of the total height of the to be formed retaining wall.

In the 5 foot by 9 foot panels, only a lower portion of the rear face of the panel includes a rearwardly projecting section of geogrid connected at opposite side edges to the wall panel. Fill material is then deposited within all the confinement cells at the rear faces of the panels of juxtaposed panels.

When each confinement cell is filled in the lowermost course, backfill material is deposited on top of, behind and between each of the confinement cells to a height approximately 4 inches above the uppermost edge of the confinement cells.

In the upper portions of each of the 5 by 9 foot panels, a second confinement cell is formed by connecting geogrid or the like above the fill material at the rear face of the panel. On top of each of the short (2.5 by 9 foot) wall panels, and intermediate the original full size (5 by 9 foot) wall panels, additional full size panels are positioned and confinement cells are formed in the lower portions thereof so that a second course of confinement cells is created across the full width of the retaining wall. As with the preceding course of formed cells, fill material is initially placed within the confinement cell until a uniform distribution of fill material within the confinement cell is achieved. Then, backfill material is added on top of and around the cell to fill the area between the rear of the cell and the cut face behind the to be formed retaining wall.

By the creation of confinement cells and successive filling of superimposed courses of such cells with layers of fill material, juxtaposed panels are interlocked with respect to one another side to side and top to bottom as the staggered, offset panels are raised in height to form the retaining wall. In this manner, a retaining wall is formed and the facing panels supported in an area of limited depth with confinement cells of greatly reduced cost as compared to the prior art concrete structural forms.

It is considered as being within the scope of the present invention to use alternative size and shape wall panels, such that a retaining wall can be formed of a single course of wall panels or wall panels of equal height and width so that one-half size panels are not required in a first and last course of panels. In addition, wall panels with non-parallel side edges may be used with the geogrid connected to the wall panels at vertical lines spaced inwardly from the side edges.

Accordingly, it is another object of the present invention to provide a highly efficient method for erecting a retaining wall in an area of limited depth by the sequential formation of courses of semicircular fill-containing confinement cells behind vertically staggered juxtaposed precast concrete wall panels projecting from a rear face thereof made preferably of a grid-like sheet of material.

It is another object of the present invention to form such confinement cells from sheets of grid-like material, preferably uniaxially oriented integral geogrid sheets, the ends of which are anchored to opposite sides of the wall panels.

It is yet another object of the present invention to erect a retaining wall of precast concrete wall panels having a plurality of superimposed confinement cells made of sheet material extending from opposite side edges of the panels.

It is still another object of the present invention to form such confinement cells from a sheet of grid-like material with a layer of geofabric or the like located between the grid and fill material contained within the confinement cell to minimize loss of fill.

It is a further object of the present invention to provide a retaining wall formed of a plurality of wall panels having approximately semi-circular shaped confinement cells extending from their rear face with the opposite ends of the sheet-like material forming the confinement cells being connected to opposite side edges of the wall panels by a Bodkin connection or by an interference fit in channels defined in the rear face of each panel.

These and other objects of the invention, as well as many of the attendant advantages thereof, will become more readily apparent when reference is made to the following description taken in conjunction with the accompanying drawings.

DETAILED DESCRIPTION OF THE PREFERRED EMBODIMENTS

Figure 1:
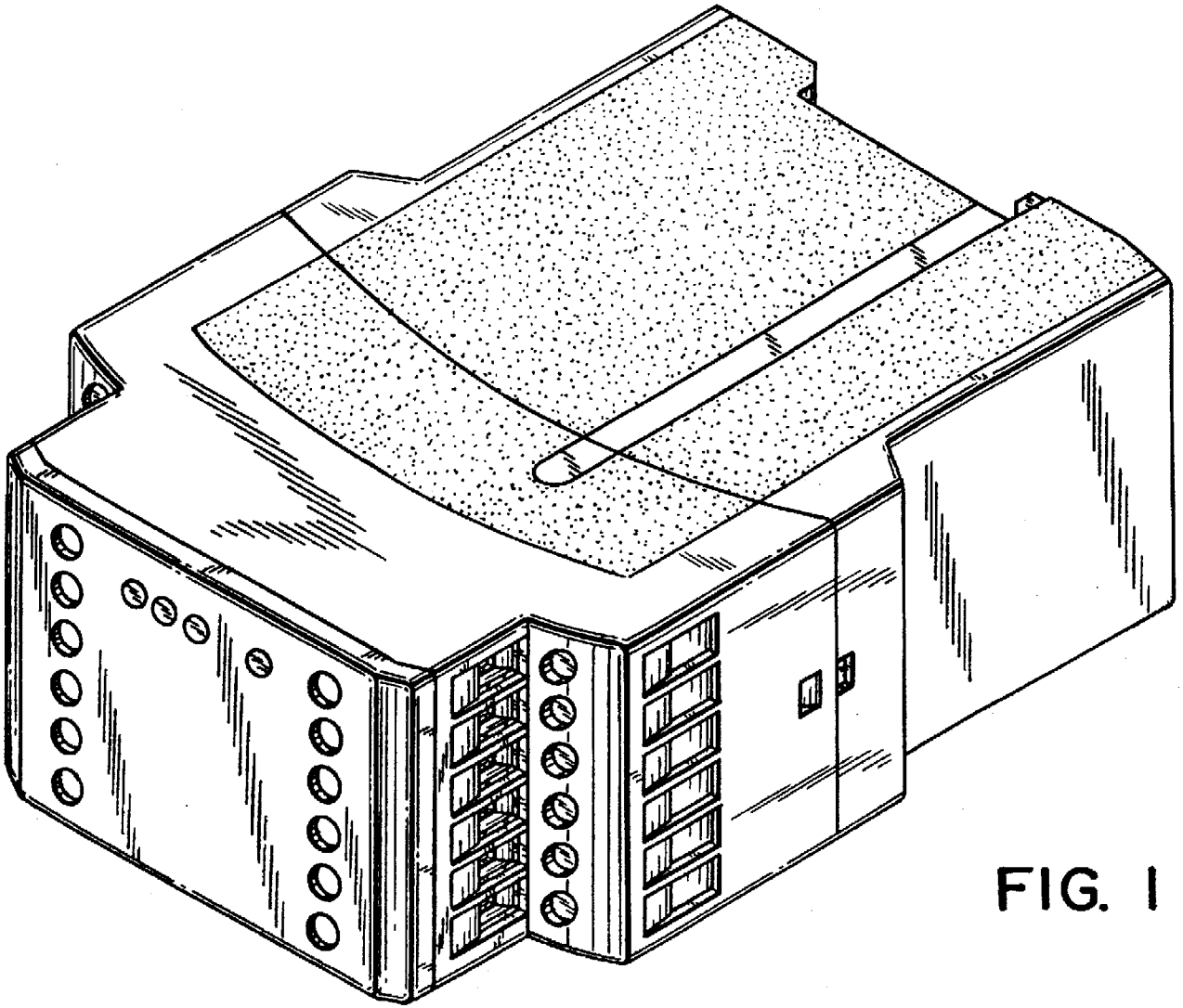
FIG. 1 is a perspective view of a retaining wall according to the instant invention erected in a cut wall environment or limited depth area.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

With reference to the drawings, in general, and to FIG. 1, in particular, a retaining wall embodying the teachings of the subject invention is generally designated as 10. As shown in FIG. 1, the retaining wall 10 is located in front of an embankment or cut wall face 12 with a depth 14 for fill material between the retaining wall and the embankment, making the conventional use of a plurality of vertically spaced, generally horizontally extending, layers of tie-back sheet material, impractical.

Figure 2:
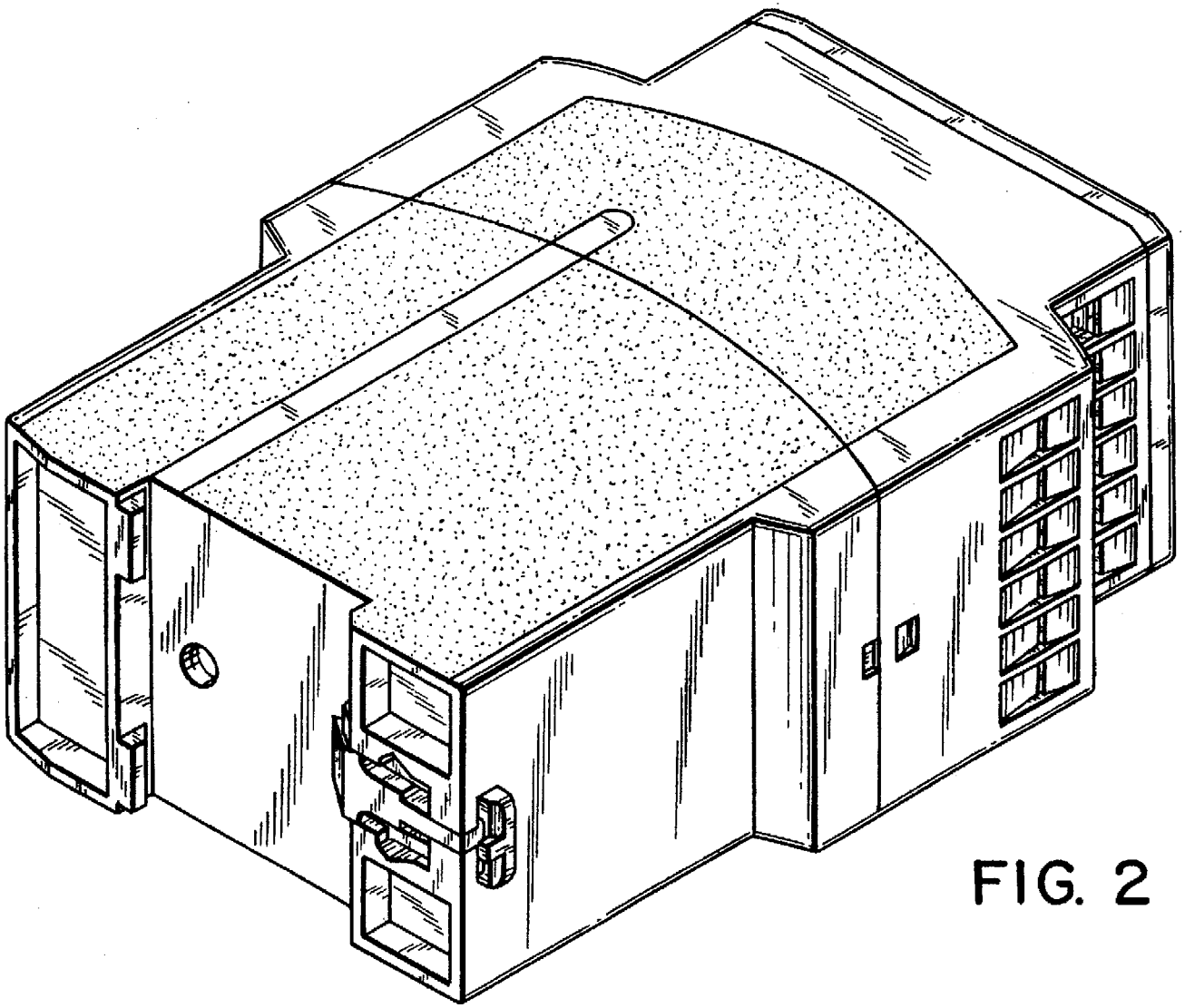
FIG. 2 is a front elevational view of such a retaining wall illustrating in dotted lines the confinement cells extending from a rear face of each precast wall panel.

The retaining wall 10 is made up of a plurality of full size precast concrete wall panels 16 having a preferred dimension of 5 feet tall by 9 feet wide. It is understood that the dimensions of the wall panels may change without departing from the principles of this invention. In the first and last course of assembled wall panels in the wall 10, the full size wall panels 16 are alternated with half panels 18 of a preferred size of 2.5 feet tall by 9 feet wide. As will be explained in more detail with respect to the other Figures, the full size panels 16 will have two vertically spaced confinement cells **20*a* and 20*b* formed behind them, whereas the half size panels 18 will each include a single confinement cell 20, as schematically shown by the dotted lines in FIG. 2**.

Figure 4:
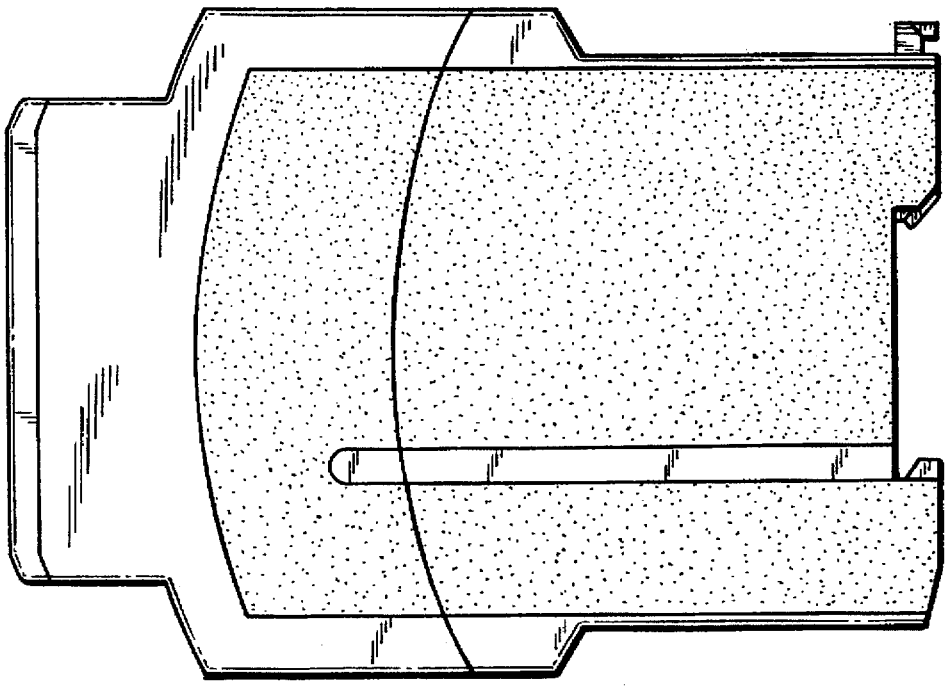
FIG. 4 is an enlarged detailed view of a Bodkin connection between a geogrid tab projecting from a rear face of a precast concrete wall panel and the end portion of a section of vertically oriented geogrid used to define the confinement cell.
Figure 5:
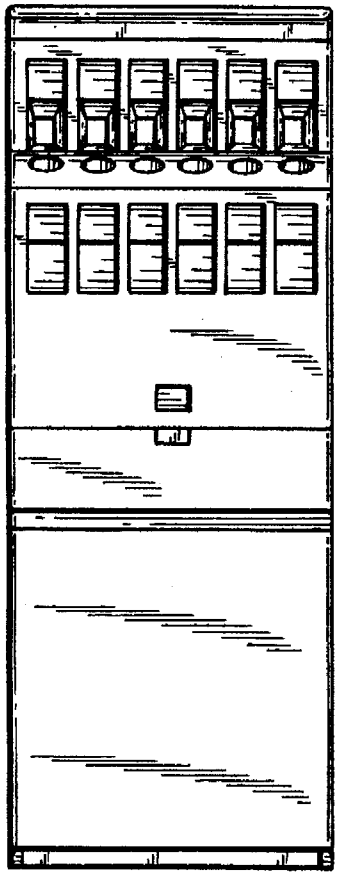
FIG. 5 is a plan view illustrating a course of confinement cells extending rearwardly from the rear faces of precast wall panels.

Each wall panel 16, 18 is conventionally precast of concrete or the like and includes a reinforcing steel or welded wire mesh 22 which extends substantially throughout the entire panel. In a preferred embodiment, as shown in FIGS. 4 and 5, a tab 24 of geogrid or the like is anchored at one end 26 adjacent each side edge 30 of the precast wall panels 16, 18. Preferably the tab 24 comprises a UX integral geogrid and at least one vertically extending bar 28 of the geogrid tab is captured in the concrete of the panel during manufacture.

One end 34 of a length of UX geogrid 32 may be secured to the free end 38 of the tab 24 by a Bodkin connection shown schematically at 36. An anchoring rod 40 extends through the loop formed by the interengaged end 38 of geogrid 24 and end 34 of geogrid 32. The opposite end 42 of the length of geogrid 32 is anchored adjacent the opposite side edge 44 of the concrete wall panel by a second Bodkin joint shown schematically at 46. Thus, the opposed ends of each length of geogrid 32 are secured adjacent the opposite side edges 30, 44 of each wall panel with the major portion of the geogrid spaced from the rear surface of the panels.

Figure 3:
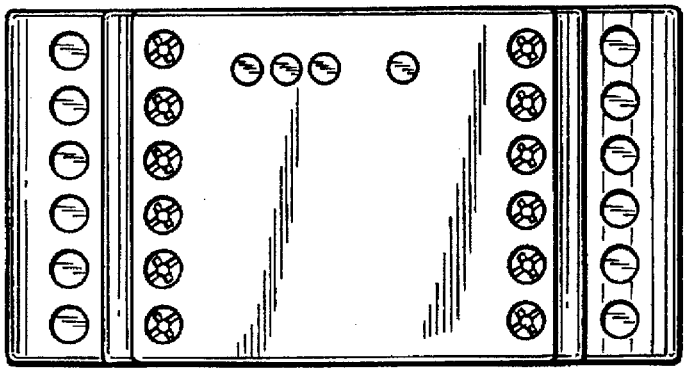
FIG. 3 is a vertical cross-sectional view taken along line 3—3 of FIG. 1.

As shown in FIGS. 3 and 5, a length of geofabric 48 may line the interior of the length of geogrid 32 so as to prevent migration of fill material through the openings 50 formed between the horizontally extending strands 52, and vertically extending transverse bars 54 of the grid material.

In the construction of a retaining wall according to the principles of the present invention, a concrete toe pad 56 is first cast in place, spaced from an embankment or cut wall face 12. The toe pad 56 preferably a stepped portion 58 for receiving a stepped lowermost edge 60 of a wall panel 16, 18. In the initial course, full size wall panels 16 are alternated with half-size wall panels 18 as seen particularly in FIGS. 1 and 2. A single section 32 of geogrid is then connected to the opposite sides of each panel; at the bottom half of a full size panel 16 and across the width of a half-panel 18. The space 62 between the rear face 64 of the panels 16, 18 and the interior of a vertically oriented section of geogrid 32, possibly including a geofabric 48, is filled with particulate material until the geogrid 32 assumes a taut condition as shown in FIG. 5 thereby defining a first course of laterally spaced confinement cells 20, **20*a* behind the panels 18, 16**, respectively.

Figure 6:
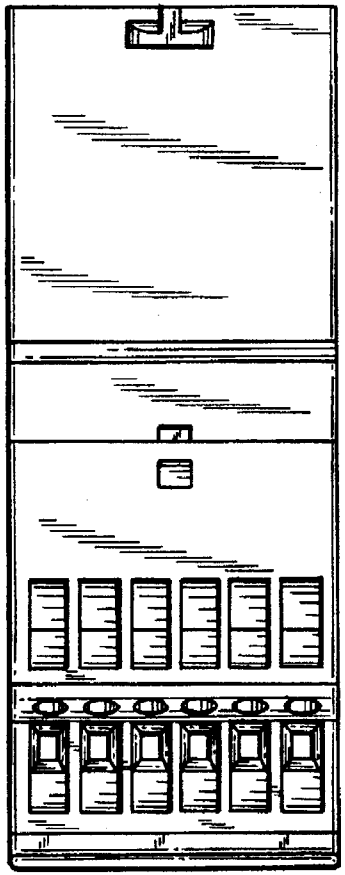
FIG. 6 is a side elevational view of two confinement cells projecting rearwardly from the rear face of a single full height precast wall panel.

When the first course of confinement cells 20, **20*a* are filled, the remainder of the area between the cells and behind the cells to the embankment or cut wall face 12 is filled to a level 66 above the upper surface of the geogrid 32 as shown in FIG. 3 and 6. A full size panel 16' is then placed on top of each half panel 18 between the laterally spaced full panels 16. A single length of geogrid 32 is then secured between opposite edges of the bottom half of each full size panel 16' on top of the previously filled confinement cells 20, and the upper half of adjacent full size panels 16, on top of the previously filled lower half confinement cell 20*a*. This newly formed course of confinement cells is filled until each cell assumes a substantially flexed condition, after which the area surrounding each such confinement cell is packed with particulate material to the level 66' or 68' as shown in FIG. 3**.

At this point, full panels 16" are placed on top of full panels 16 until an appropriate upper height of the retaining wall is reached at which point, half panels 18' are used to form the upper edge 70 of the formed retaining wall 10. Although only two full panels are illustrated, it is evident that additional courses of precast wall panels may be sequentially supported in a similar manner. The confinement cells and fill material are stacked until the desired height of the retaining wall is obtained.

Figure 7:
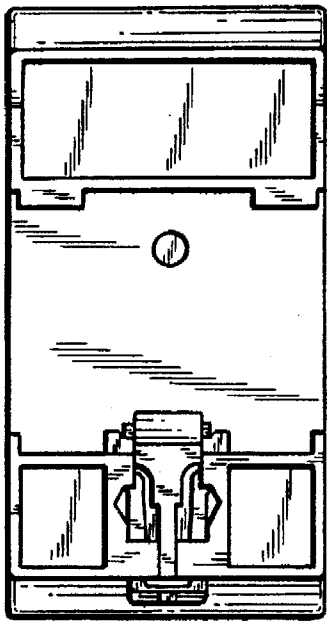
FIG. 7 is a front elevational view of a retaining wall made of wall panels of equal size.
Figure 1:
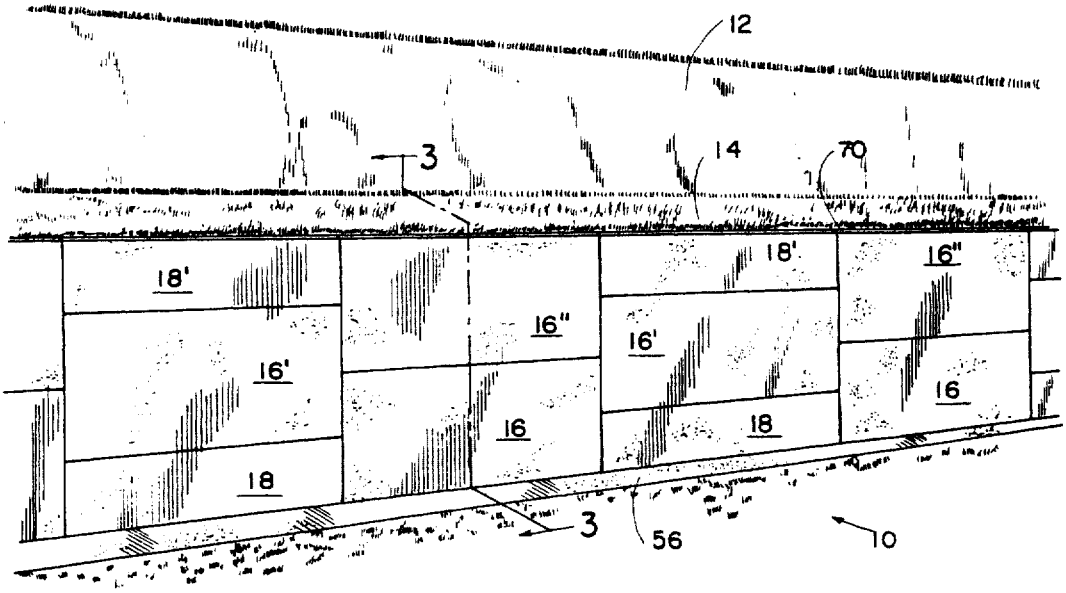
Figure 2:
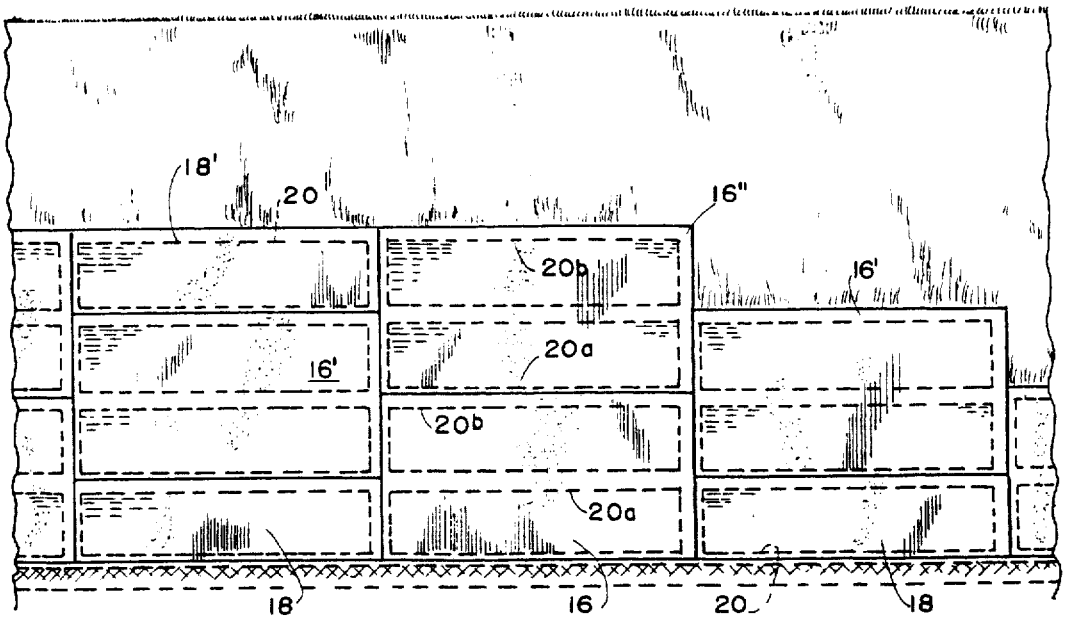
Figure 5:
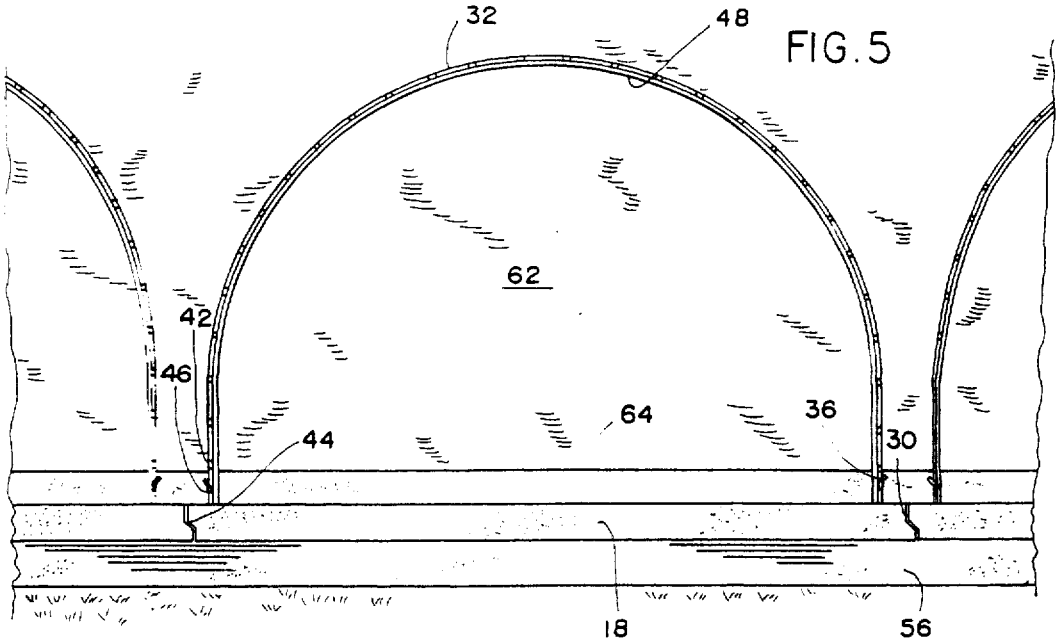
Figure 6:
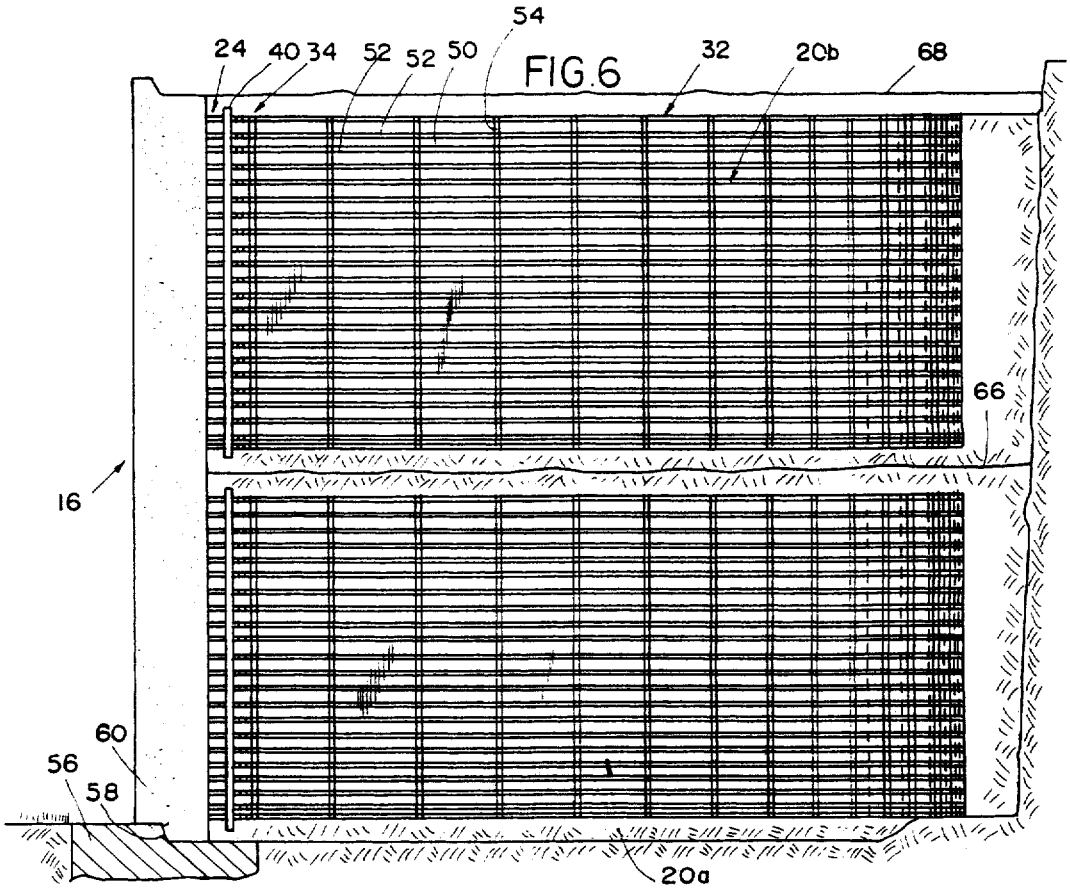
Figure 7:
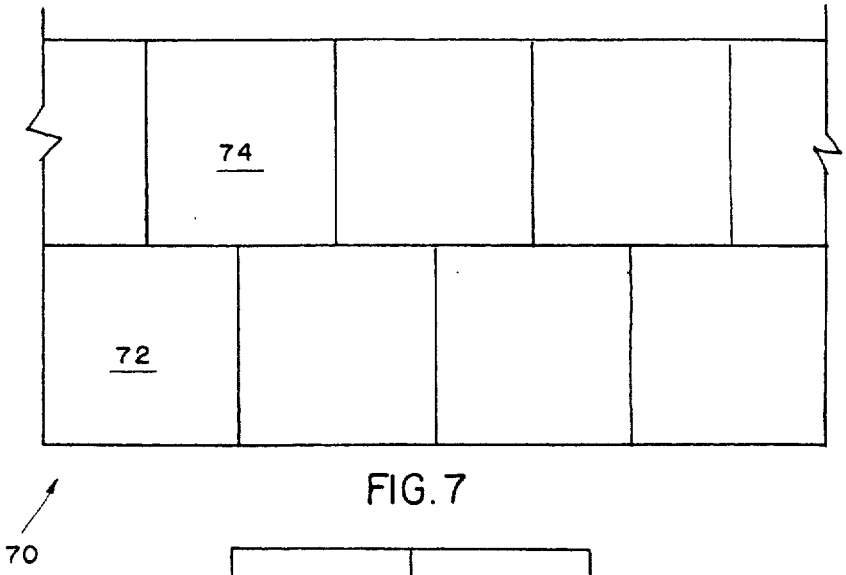
Figure 8:
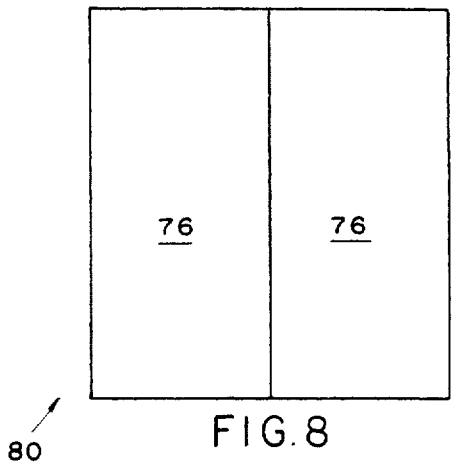
FIG. 8 is a front elevational view of a retaining wall made of wall panels of equal size and a total height of one wall panel.

FIGS. 7 and 8 illustrate alternative retaining walls embodying the teachings of the present invention. In FIG. 7, a retaining wall 70 includes a plurality of square wall panels 72. In a second course, wall panels 74, equal in size to panels 72, are staggered with respect to the first course of panels 72. It is understood that panels 72, 74 incorporate the use of a confinement cell in accordance with the principles of the present invention.

In FIG. 8, wall panels 76 extend to the full height of a retaining wall 80 made of a single course of panels 76. These panels may include two superimposed confinement cells installed in layers as is disclosed with respect to FIG. 3.

Figure 9A:
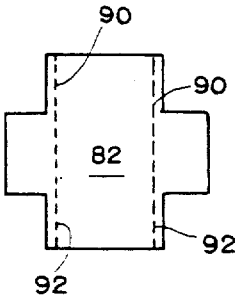
FIG. 9A–9D are front elevational views of alternative wall panels.
Figure 9B:
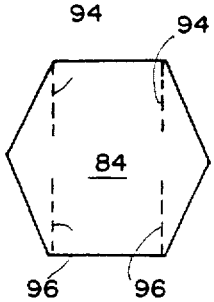
Figure 9C:
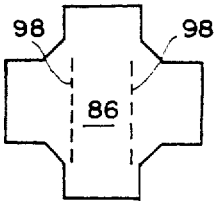

In FIGS. 9A–9D, alternative wall panels 82, 84, 86 and 88 are shown. Although these panels have either non-parallel top/bottom or side edges, they are suitable for use with the concepts of the present invention. With reference to FIG. 9A, two sets of geogrid connection lines are schematically shown by vertically extending dotted lines 90 and 92. these lines represent attachment of opposite ends of two lengths of geogrid at points spaced inwardly from the outwardmost side edges of the panel 92. Similarly, in FIG. 9B, two sets of connection lines 94 and 96 are illustrative of two confinement cells behind panel 86.

Figure 9D:
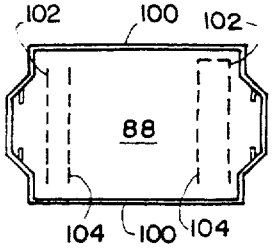

In FIG. 9D, although panel 88 includes parallel top and bottom edges 100, it is possible to locate vertical confinement cell connection lines 102 along its side edges or spaced inwardly from side edges along vertical confinement cell connection lines 104. It is therefore seen that the grid connection lines for a confinement cell according to the principles of the present invention need not be located along the side edges of a wall panel but merely be vertically extending and projecting from a rear face of the wall panel.

The foregoing description should be considered as illustrative only of the principles of the invention. Since numerous modifications and changes will readily occur to those skilled in the art, it is not desired to limit the invention to the exact construction and operation shown and described, and, accordingly, all suitable modifications and equivalents may be resorted to, falling within the scope of the invention. For example, although two confinement cells are shown behind each full size wall panel, it is to be understood that, with the selection of appropriate dimensional relationships between the wall panels used in the formation of the retaining walls and the sheets of geogrid or the like used to form the confinement cells, more than two levels of confinement cells may be provided behind each wall panel. Moreover, while preferred, it is not necessary to provide confinement cells behind every wall panel, particularly in constructing retaining walls of limited height.

What is claimed is:

1. A fill material confinement cell comprising:

a wall panel having a front surface and a rear surface, said front surface defining at least a part of a face of a retaining wall, and a vertically oriented arched sheet of material having opposed end portions secured respectively to and extending from said rear surface of said wall panel to define a confinement cell between said wall panel and said sheet of material, said confinement cell being filled with particulate material so as to uniformly outwardly flex the sheet of material with respect to said confinement cell.

2. A fill material confinement cell as claimed in claim 1, wherein said sheet of material is a grid-like sheet of material having a multiplicity of openings.

3. A fill material confinement cell as claimed in claim 2, further including a geofabric spanning the openings of said grid-like sheet of material.

4. A fill material confinement cell as claimed in claim 2, wherein said grid-like sheet of material is an uniaxially stretched polymer geogrid and said openings are defined by a plurality of molecularly oriented elongated strands interconnected by transversely extending elements.

5. A fill material confinement cell as claimed in claim 4, wherein said transversely extending elements are thickened bars.

6. A fill material confinement cell as claimed in claim 5, wherein said bars extend vertically.

7. A fill material confinement cell as claimed in claim 1, wherein said wall panel includes tabs of grid-like sheet material projecting from said rear surface of said wall panel along each side edge thereof, and said end portions of said sheet of material are secured respectively to said tabs.

8. A fill material confinement cell as claimed in claim 7, wherein said sheet of material is a grid-like sheet of material and wherein said end portions of said sheet of material are secured respectively to said tabs by Bodkin connections.

9. A fill material confinement cell as claimed in claim 1, wherein said wall panel is cementitious.

10. A retaining wall comprising:

a cut wall face, a plurality of wall panels vertically stacked, each wall panel having a vertically extending front face and a vertically extending rear face, said front face defining at least a part of a face of the retaining wall and said rear faces being spaced from said cut wall face, a vertically oriented arched sheet of material having opposed end portions secured respectively to and extending from said rear face of said wall panels to define confinement cells between said rear faces of said wall panels and said cut wall face, and particulate fill material contained within said cells so as to uniformly outwardly flex the sheet of material with respect to said confinement cell.

11. A retaining wall as claimed in claim 10, further including additional fill material between said cells and between said cells and said cut wall face.

12. A retaining wall as claimed in claim 11, wherein said sheet of material is a grid-like sheet of material defining a multiplicity of openings.

13. A retaining wall as claimed in claim 12, wherein said grid-like sheet of material is an uniaxially stretched polymer geogrid having a plurality of molecularly oriented elongated strands interconnected by transversely extending elements together defining said openings.

14. A retaining wall as claimed in claim 13, wherein said grid-like sheet of material includes a geofabric spanning said openings.

15. A retaining wall as claimed in claim 13, wherein said transversely extending elements are thickened bars.

16. A retaining wall as claimed in claim 15, wherein said bars extend vertically.

17. A retaining wall as claimed in claim 10, wherein each of said wall panels includes tabs of grid-like sheet material projecting from said rear face of said wall panel along each side edge thereof, and said end portions of said sheet of material are secured respectively to said tabs.

18. A retaining wall as claimed in claim 17, wherein said sheet of material is a grid-like sheet of material and wherein said end portions of said sheet of material are secured respectively to said tabs by Bodkin connections.

19. A retaining wall as defined in claim 10, comprising a plurality of laterally juxtaposed rows of vertically elongated stacked wall panels, and wherein said wall panels in adjacent rows are vertically staggered with respect to each other.

20. A retaining wall as defined in claim 19, further comprising a plurality of vertically spaced cells defined behind at least some of said wall panels.

21. A retaining wall as claimed in claim 20, further including filling any remaining space between said sheet of material and said cut wall face with fill material.

22. A fill material confinement cell as claimed in claim 10, wherein each of said wall panels is cementitious.

23. A method of building a retaining wall, said method comprising:

aligning a first course of vertically extending wall panels, securing opposite ends of a sheet of material in a vertical orientation to extend from a rear face of at least some of said wall panels to form confinement cells between said rear face and said sheet of material, and filling said confinement cells with fill material so as to outwardly flex the sheet of material with respect to the confinement cells.

24. A method of building a retaining wall as claimed in claim 21, wherein a plurality of successive courses of wall panels are assembled and confinement cells are formed and filled behind selected wall panels until reaching a predetermined height.

25. A method of building a retaining wall as claimed in claim 24, wherein a maximum depth of the space between said rear face and said sheet of material is in the range of 35 to 45% of said predetermined height.

26. A method of building a retaining wall as claimed in claim 23, wherein said sheet of material is a grid-like sheet of material defining a multiplicity of openings.

27. A method of building a retaining wall as claimed in claim 26, wherein said grid-like sheet of material is an uniaxially stretched polymer geogrid having a plurality of molecularly oriented elongated strands interconnected by transversely extending elements together defining said openings.

28. A method of building a retaining wall as claimed in claim 27, wherein said grid-like sheet of material includes a geofabric spanning said openings.

29. A method of building a retaining wall as claimed in claim 27, wherein said transversely extending elements are thickened bars.

30. A method of building a retaining wall as claimed in claim 29, wherein said bars extend vertically.

31. A method of building a retaining wall as claimed in claim 23, wherein each of said wall panels includes tabs of grid-like sheet material projecting from said rear face of said wall panel along each side edge thereof, and end portions of said sheet of material are secured respectively to said tabs.

32. A method of building a retaining wall as claimed in claim 31, wherein said sheet of material is a grid-like sheet of material and wherein said end portions of said sheet of material are secured respectively to said tabs by Bodkin connections.

33. A method of building a retaining wall as claimed in claim 23, wherein said first course of wall panels includes alternating full size and part size wall panels.

34. A method of building a retaining wall as claimed in claim 33, wherein said part size wall panels are one-half the height of said full size panels.

35. A method of building a retaining wall as claimed in claim 33, wherein a final course of wall panels includes alternating full size and part size wall panels.

* * * * *

UNITED STATES PATENT AND TRADEMARK OFFICE

CERTIFICATE OF CORRECTION

PATENT NO. : 5,697,735
DATED : December 16, 1997
INVENTOR(S) : Philip D. Egan

It is certified that error appears in the above-identified patent and that said Letters Patent is hereby corrected as shown below:

The title page should be deleted and substitute therefor the attached title page. Delete Drawing Sheets 1-4, and substitute therefor the Drawing Sheets, consisting of FIGS. 1-9d, as shown on the attached pages.

Signed and Sealed this

Seventh Day of April, 1998

Bruce Lehman

*Attest:*

BRUCE LEHMAN

*Attesting Officer*

*Commissioner of Patents and Trademarks*

United States Patent [19]

Egan

[11] Patent Number: 5,697,735

[45] Date of Patent: Dec. 16, 1997

[54] CUT WALL CONFINEMENT CELL

[75] Inventor: Philip D. Egan, Atlanta, Ga.

[73] Assignee: The Tensar Corporation, Atlanta, Ga.

[21] Appl. No.: 461,850

[22] Filed: Jun. 5, 1995

[51] Int. Cl.[6] ..... E02D 3/02; E02D 29/00

[52] U.S. Cl. ..... 405/262; 405/284; 405/286

[58] Field of Search ..... 405/262, 258, 405/284, 286

[56] References Cited

U.S. PATENT DOCUMENTS

| | | | |
|---|---|---|---|
| D. 274,762 | 7/1984 | Toffolon | D34/33 |
| 4,011,728 | 3/1977 | Turzillo | 405/222 |
| 4,050,254 | 9/1977 | Meheen et al. | 405/285 |
| 4,196,161 | 4/1980 | Toffolon et al. | 264/71 |
| 4,251,196 | 2/1981 | Toffolon et al. | 425/173 |
| 4,324,508 | 4/1982 | Hilfiker et al. | 405/284 |
| 4,341,491 | 7/1982 | Neumann | 405/262 X |
| 4,351,507 | 9/1982 | Toffolon et al. | 249/63 |
| 4,372,091 | 2/1983 | Brown et al. | 52/593 |
| 4,374,798 | 2/1983 | Mercer | 264/288.8 |
| 4,474,400 | 10/1984 | Toffolon | 294/97 |
| 4,530,622 | 7/1985 | Mercer | 405/258 |
| 4,684,294 | 8/1987 | O'Neill | 405/286 |
| 4,685,838 | 8/1987 | Curt | 405/284 |
| 4,707,962 | 11/1987 | Meheen | 52/565 |
| 4,728,227 | 3/1988 | Wilson et al. | 405/284 |
| 4,824,293 | 4/1989 | Brown et al. | 405/284 |
| 4,914,887 | 4/1990 | Meheen | 405/284 |
| 4,929,125 | 5/1990 | Hilfiker | 405/262 |
| 5,131,791 | 7/1992 | Kitziller | 405/286 |
| 5,190,413 | 3/1993 | Carey | 405/262 X |
| 5,259,704 | 11/1993 | Orgorchock | 405/262 |
| 5,320,455 | 6/1994 | Mattox | 405/262 X |
| 5,378,088 | 1/1995 | Foehrkolb | 405/262 X |
| 5,505,563 | 4/1996 | Curt | 405/262 |

OTHER PUBLICATIONS

Doublewal "The Interlocking Precast Gravity Wall System" Brochure.

T-Wall "Construction Procedures" Brochure.

Tensar "Concrete GeoWall Package" Brochure.

Brochure—"Terra-Link, Cellular Earth Retaining Structures", 28 pages.

*Primary Examiner*—Tamara L. Graysay

*Assistant Examiner*—Tara L. Mayo

*Attorney, Agent, or Firm*—Jacobson, Price, Holman & Stern, PLLC

[57] ABSTRACT

Precast concrete wall panels are assembled to form a retaining wall in front of a cut wall face. Arched confinement cells are formed behind the wall panels by sections of vertically oriented sheet material for reception and retention of a particulate fill material. Preferably, flat, precast concrete wall panels provided with vertically oriented tabs of integral geogrid projecting rearwardly from opposite sides of a rear face thereof which are connected to opposite end portions of a length of vertically oriented geogrid by a Bodkin joint. The thus formed confinement cells are generally semi-circular. The fill material initially used fills the confinement cells and then the space around the confinement cells and in front of the cut wall face. The wall panels are vertically staggered and successive courses of confinement cells are filled until reaching a desired height for the retaining wall.

35 Claims, 4 Drawing Sheets

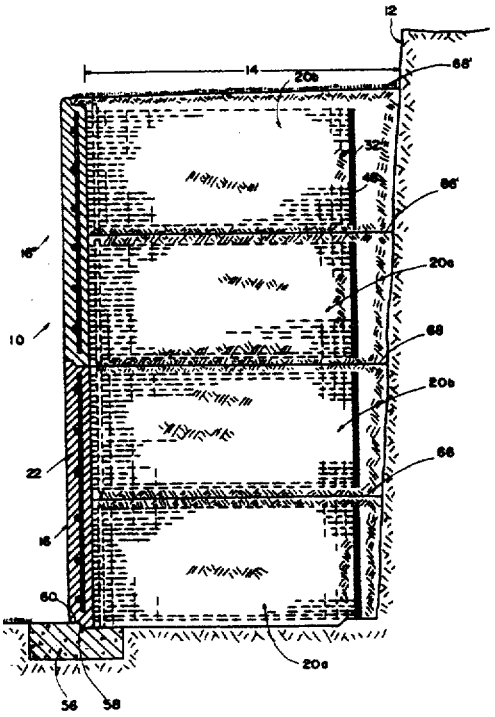

FIG. 3
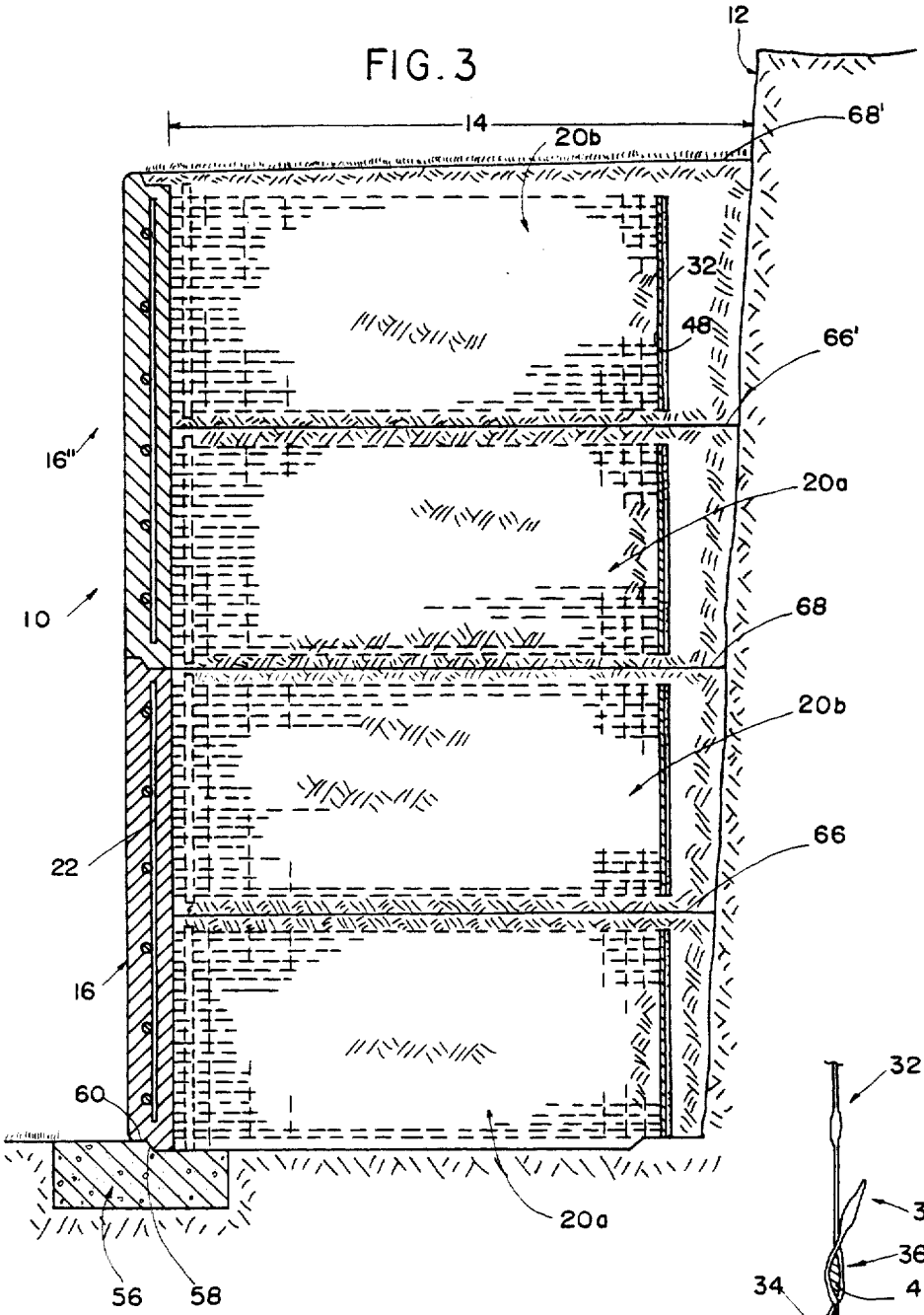
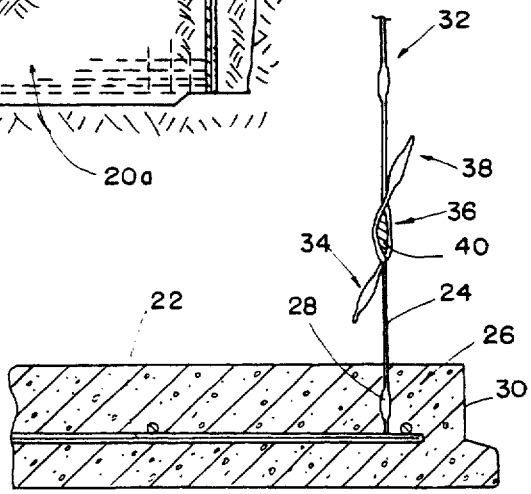
FIG. 4